US011299389B2

(12) United States Patent
Fenaroli

(10) Patent No.: US 11,299,389 B2
(45) Date of Patent: Apr. 12, 2022

(54) SADDLE WITH INTERFACE HAVING PASSIVELY MORPHING ELEMENTS AND METHOD OF USE

(71) Applicant: Donald Nelson Fenaroli, San Jacinto, CA (US)

(72) Inventor: Donald Nelson Fenaroli, San Jacinto, CA (US)

(73) Assignee: Jacqueline Fenaroli, San Jacinto, CA (US)

( * ) Notice: Subject to any disclaimer, the term of this patent is extended or adjusted under 35 U.S.C. 154(b) by 73 days.

(21) Appl. No.: 16/128,577

(22) Filed: Sep. 12, 2018

(65) Prior Publication Data

US 2019/0077653 A1 Mar. 14, 2019

Related U.S. Application Data

(60) Provisional application No. 62/557,326, filed on Sep. 12, 2017.

(51) Int. Cl.
*B68C 1/04* (2006.01)
*B68C 1/12* (2006.01)
*B68C 1/02* (2006.01)

(52) U.S. Cl.
CPC ..... *B68C 1/04* (2013.01); *B68C 1/025* (2013.01); *B68C 1/12* (2013.01); *B68C 2001/042* (2013.01)

(58) Field of Classification Search
CPC ..... B68C 1/04; B68C 2001/042; B68C 1/025; B68C 1/02; B68C 1/12; B68C 2001/23; B62J 1/00; B62J 1/18; B62J 1/24
USPC ..... 54/44.5, 44.7, 44.3, 65, 66, 41.1; 297/284.3
See application file for complete search history.

(56) References Cited

U.S. PATENT DOCUMENTS 4,134,166 A * 1/1979 Schuder ..... A47C 27/10 5/710
4,745,734 A * 5/1988 Brown ..... B68C 1/02 54/44.1
5,027,589 A * 7/1991 Gleb ..... B68C 1/12 54/66
5,119,618 A * 6/1992 Streck ..... B68C 1/12 54/66
5,274,986 A * 1/1994 Gonzales ..... B68C 1/04 54/44.1

(Continued)

*Primary Examiner* — Shada Mohamed Alghailani
(74) *Attorney, Agent, or Firm* — Flyer & Flyer, a Professional Law Corp.; David R. Flyer

(57) ABSTRACT

Saddle with passively morphing interface panels and method of use, wherein passively morphing interface panels morphs in surface profile to be reshaped upon contact with a supporting surface of a horse's dynamic back and of horses of varying sizes and shapes, so that a direct load path is created from the riders concentrated downward weight on a chassis through a pair of symmetrically opposed line of contact edges, aligned with tilted sagittal plane sections through the horse's back surface, and making contact with the midline area of opposed pair of elements made of rigid materials that are caused to tip out of plane until moment forces are balanced, which occurs when the element's entire length makes contact with the supporting horse's back causing the elements interface's surface profile to be reshaped, without directed input, to momentarily match the varying supporting surface profiles of a horse's dynamic back.

6 Claims, 10 Drawing Sheets

(56) References Cited

U.S. PATENT DOCUMENTS 5,363,631 A * 11/1994 Garrison ..... B68C 1/12 54/66
5,435,116 A * 7/1995 Brown ..... B68C 1/04 54/44.5
5,575,139 A * 11/1996 Green ..... B68C 1/12 54/66
5,834,543 A * 11/1998 Garrison ..... B68C 1/12 524/198
5,884,459 A * 3/1999 Biddlecome ..... B68C 1/04 54/44.1
6,050,067 A * 4/2000 Knight ..... B32B 5/22 54/44.6
6,095,611 A * 8/2000 Bar ..... A61G 5/1067 297/440.21
6,415,583 B1 * 7/2002 Landi ..... B68C 1/12 54/44.7
6,615,568 B1 * 9/2003 Roskies ..... B68C 1/12 54/66
6,948,256 B2 * 9/2005 Ferrand ..... B68C 1/00 33/511
7,472,531 B2 * 1/2009 Fennelly ..... B68C 1/12 54/66
7,648,201 B2 * 1/2010 Eysing ..... A47C 7/405 297/284.3
8,020,362 B2 * 9/2011 Kroetch ..... B68C 1/04 54/44.3
8,281,560 B2 * 10/2012 Weidner ..... B68C 1/02 54/44.7
8,424,967 B2 * 4/2013 Kilincsoy ..... D04B 21/14 297/284.3
8,490,370 B1 * 7/2013 Riggleman ..... B68C 1/12 54/66
2003/0051447 A1 * 3/2003 Bruce ..... B68C 1/02 54/44.1
2005/0086914 A1 * 4/2005 Fennelly ..... B68C 1/12 54/66
2007/0006555 A1 * 1/2007 Italiano ..... B68C 1/12 54/66
2007/0107388 A1 * 5/2007 Williams ..... B68C 1/12 54/66
2008/0110414 A1 * 5/2008 Buehner ..... A01K 13/006 119/712
2008/0134647 A1 * 6/2008 Dominique ..... B68C 1/10 54/44.1
2008/0217977 A1 * 9/2008 Aldrich ..... A47C 7/40 297/284.3
2009/0181206 A1 * 7/2009 Chang ..... A01K 13/007 428/71
2009/0236887 A1 * 9/2009 Lu ..... A47C 31/126 297/284.3
2011/0072768 A1 * 3/2011 Wuerminghausen ... B68C 1/126 54/44.5
2011/0258974 A1 * 10/2011 Brander ..... B68C 1/16 54/37.1
2013/0269300 A1 * 10/2013 Konzet ..... B68C 1/025 54/44.1
2014/0159450 A1 * 6/2014 Guering ..... B60N 2/68 297/284.3
2015/0121820 A1 * 5/2015 Mahajan ..... B68C 1/12 54/66
2015/0175230 A1 * 6/2015 Baruzzo ..... B62J 1/28 297/214
2015/0189996 A1 * 7/2015 Scarlett ..... A47C 27/14 5/722
2015/0232322 A1 * 8/2015 Aguilar ..... B68C 1/025 54/44.7
2016/0166080 A1 * 6/2016 Mascull ..... A61G 5/1043 5/722
2016/0167726 A1 * 6/2016 Dudley, II ..... B62J 1/005 297/284.3
2017/0183216 A1 * 6/2017 Kaden ..... B68C 1/025
2018/0162718 A1 * 6/2018 Brander ..... B68C 1/04
2019/0077653 A1 * 3/2019 Fenaroli ..... B68C 1/025
2019/0141952 A1 * 5/2019 Hsi-Chang ..... B68C 1/12 119/850

* cited by examiner

SADDLE WITH INTERFACE HAVING PASSIVELY MORPHING ELEMENTS AND METHOD OF USE

CROSS-REFERENCE TO RELATED APPLICATIONS

The present application claims priority under 35 U.S.C. 119(e) and under all applicable U.S. statutes and regulations, to U.S. Provisional Application Ser. No. 62/557,326 filed Sep. 12, 2017. The disclosure of which is hereby incorporated herein by reference in its entirety.

FIELD OF THE INVENTION

The invention relates to devices for mounting or loading the back of an animal and provides improvements in the way that loads are distributed from the rider or other load to the animal. In particular the invention broadly offers improvements in saddlery and especially provides a new saddle structure design which allows the horse and rider full range of motion and a method for using the device as a saddle to evenly distribute a concentrated downward force to a supporting surface (such as a horse, donkey, mule, etc.) with changing profile. The primary application for this invention is an equine saddle so as to distribute the concentrated downward force evenly across the supporting surface profile area, where the concentrated downward force comes from a mounted rider and the changing supporting surface profile is a back of a dynamic horse and of equines of different sizes and shapes. However, additional applications can extend beyond this domain.

BACKGROUND OF THE INVENTION

Early saddles lacked stirrups and thereby had several shortcomings. For example, with no stirrups, the rider had to use his hands to better stay on the horse. This hindered his ability to perform tasks such as hunting. In addition, the rider suffered discomfort when the horse galloped in that he could not effectively separate his groin area from the horse's back, and in that he may lose his balance and fall off the horse's back.

The introduction of stirrups helped alleviate some of the aforementioned problems in that the rider could more easily "brace" and "balance" himself by exerting force on the stirrups with his feet. Consequently, his hands were more free to hunt or otherwise control the horse. Furthermore, he could "stand" in the stirrups to separate his mid-section from a galloping horse's back, and his balance was improved by standing on his feet.

The introduction of the stirrup, however, required a rigid frame or "tree" for best anchoring of the stirrup straps. For example, in order for the rider to "stand" in a stirrup, the stirrup should be firmly anchored to a rigid frame.

There exists a variety of methods to measure the back surface profile of a horse and it is accepted that there are meaningful differences between equines in size and shape. It is also accepted that a particular equines back may change shape with movement, weight gain or loss, conditioning, health, training, rider weight and equitation habits.

The stirrups' need for a rigid tree made a close fit of the saddle to the horse a necessity. A rigid frame that fit poorly could create pressure points that, for example, may be areas of concentrated pressure where a small area of the frame presses down on the horse. The result could range from chaffing the horse to major sores at pressure points on the horse. Consequently, the goal became trying to ensure the weight of the rider or pack was distributed evenly over the animal's back without concentrated pressure points.

Attempts to custom fit rigid trees to specific horses presented a problem in that the same tree could not be used for other horses of different dimensions without creating concentrated pressure points and resultant pain. Furthermore, one rigid frame should not be used on horses, mules, ponies and asses because of their differing sizes and shapes due to pressure point pain. In addition, not only do different species and different individual animals within the same species vary in size and shape, an individual animal itself may have varying sizes and shapes according to changes in age and diet and locomotion. Finally, the complications with rigid trees grew in that any rider that used multiple horses with different shapes and sizes would suffer undue expense because no one saddle tree worked pain free for all horses. Until now.

A typical saddle includes a base frame or "tree" with a seat for the rider; skirts, and fenders that protect the horse from the rider's legs and vice versa; a girth that fits around the underbelly of the horse and keeps the saddle stable; and stirrups for the rider's feet.

The saddle tree is the frame on which the saddle is built. Its shape determines the shape of the saddle.

Ideally, the saddle tree should be shaped to fit the back of the horse for which the saddle is intended. Most of the time however, saddle trees are manufactured for average sizes and shapes. Saddle Trees are typically made in three angular sizes for the horse: narrow, medium, and broad, and four seat lengths: 14 inches, 15 inches, 16 inches, and 17 inches (35.6, 38.1, 40.64, and 43.2 centimeters respectively) or in increments thereof for the rider.

On a typical English saddle, the horse interface are panels or divided cushions that provide a padded surface for the horse's back while raising the tree high enough to make clearance for the animal's spine. These cushions help protect the horse's back from the hardness of the saddle and rider's bones while sitting (ischial tuberosity) and cannot distribute the rider's weight because they lack a rigid structure.

The present invention addresses these limitations mentioned in paragraph 0008 and 0012 by utilizing a saddle with one or more segmented bars having a passively morphing interface with the horse and/or utilizing a saddle that rests on one or more segmented bars having a passively morphing surface profile.

An alternative type of treeless saddle is flexible because it lacks a rigid structure. Instead, these treeless saddles have panels that are divided cushions that are pliable and made of padding and coverings or stuffed panels that can flex and deform to match a particular horse back profile. Because the treeless panel is pliable it deflects when pushed upon and therefore cannot distribute the downward force of the riders weight across the whole contact area. The result is higher pressure on the horse's back under the riders sit bones (Ischial Tuberosity) or at the stirrup attachments. Flexible saddle makers and equestrians resort to padding in an attempt to stiffen the panels and enlarge the load carrying area but will always fall short of the ideal of evenly distributed loads over the whole contact area. Hence, heavy weight riders, and those riders with narrow horses with prominent spines, are advised not to use treeless saddles because of the small load bearing area and/or contact with the horse's spine and the resulting trauma that can impart to the horse.

For centuries, people have ridden horses with a multitude of different saddles that did not provide a sufficient level of adjustability to work with animals of different shapes and sizes. However, the present invention solves that problem by working with a multitude of different animal shapes and sizes to distribute the concentrated weight of the rider via one or more segmented bars having a passively morphing interface that reshapes to match the horse's back so that the animal is protected from trauma and moves freely.

With a conventional rigid type equine saddle, the rider sits on a saddle tree, made of inflexible materials, and it is typically comprised of a seat, cantle and optional pommel for the rider in Western riding disciplines, and have a saddle interface for the horse comprised of a pair of opposing bars, the undersides of which should be ideally shaped to match the supporting surface profile of a horse back.

Given the vast array of equine back profiles and momentary changes in dynamic equine backs, it is impractical, maybe impossible, to manufacture an ideal rigid saddle tree bar for each equine and so bars are approximately shaped to average equine back profiles in discrete sizes. Therefore, some amount of uneven pressure distribution from a rigid saddle tree bar and discomfort to the supporting horse's back is a common complaint of equestrians and is entirely solved by this invention by a means to evenly distribute the weight of the rider over the contact area via a passively morphing interface which reshapes to match the supporting surface of a horse's dynamic back and of horses of different sizes and shapes.

Some treed saddles employ features to adjust the attachment of the opposing, rigid bars of the tree to aid in fitting by altering the distance and orientation between the bars, but the surface profile of the bar remains unchanged and less than ideal for many individual horses. Some equestrians resort to employing saddle pads and shimming to relieve high pressure points with varying amounts of success depending upon their abilities and the location and degree of the mismatch and technique and materials used.

But saddle fitting is not a static endeavor and if a horse's back changes shape or a rider switches horses, the padding and fitting efforts will need to be repeated.

The prior art does not suggest a saddle tree that provides a sufficient level of adjustability to work with animals of different shapes and sizes. Nor does the prior art contemplate a treeless saddle that provides satisfactory rigidity so as to prevent discomfort for the horse.

The present invention addresses these limitations by utilizing a saddle tree with an interface having one or more segmented bars for creating a passively morphing surface with the horse and/or utilizing a seat that rests on one or more segmented bars having a passively morphing surface profile between the animal and the saddle tree.

This present invention seeks to replace the existing panels, bars and/or cushions or pads that are positioned between the saddle tree and the surface profile of the animal with instead a unique interface comprising one or more rigid segmented bars, to create a passively morphing interface that reshapes and twists to match the supporting surface of a horse's dynamic back and of horses of different sizes and shapes.

This present invention utilizes one or more interfaces having one or more segmented bars that are positioned on each side of the animal and are positioned between the saddle tree and the surface profile of the animal.

SUMMARY OF THE INVENTION

The invention overcomes the problem of uneven load distribution on a variable surface by providing a direct load path from a concentrated downward force to a rigid segmented interface that passively morphs on to the surface profile to reshape and twist to match the supporting surface shape.

It is an object of this invention to provide a saddle tree for use on the back of an animal whereby localized load pressure points from a rider are eliminated, and whereby load is distributed more evenly over the entire contact area of the saddle.

It is an object of this invention to provide a saddle tree with one or more interfaces having one or more elements having a passively morphing interface to distribute the weight of the rider sitting on the saddle more evenly along the entire contact area of the saddle.

It is also an object of the present invention to utilizes one or more interfaces having one or more rigid element materials that are positioned on each side of the animal and are positioned between the saddle tree and the surface profile of the animal.

It is another object of this invention to provide a saddle tree with one or more interfaces having one or more elements that can be held in place by various holding means including gravity, Velcro® (Hook-and-loop fasteners), hinges of various types, straps or cables, pins, axle, magnets, pocket, rubber strip hinge in the present embodiment, and other means.

It is also an object of this invention to provide a saddle tree that has means to rest on one or more interfaces having one or more elements having a passively morphing interface that has the ability to reshape and twist to match the supporting surface shape to distribute the weight of the rider sitting on the saddle tree more evenly over the entire contact area of the saddle.

It is another object of this invention to replace the traditional pads that a saddle tree will rest on, with an interface having one or more elements having a passively morphing interface that has the ability to reshape and twist to match the supporting surface shape to distribute the weight of the rider sitting on the saddle tree more evenly over the entire contact area of the saddle.

It is still yet another object of this invention to replace a traditional cushion or pad that a saddle tree will rest on, with an interface having one or more elements having a passively morphing interface that has the ability to reshape and twist to match the supporting surface shape to distribute the weight of the rider sitting on the saddle tree more evenly over the entire contact area of the saddle.

It is the primary object of this invention to utilize an interface having one or more elements having a passively morphing interface that has the ability to reshape and twist to match the supporting surface and to create a line of contact, along a line of contact with the segmented rigid material, positioned underneath the weight bearing edge of the saddle chassis to alleviate and distribute the weight of the rider sitting on the saddle more evenly over the entire contact area of the saddle.

It is an object of this invention to utilize one or more elements having a passively morphing interface that is assembled from a multiplicity of rigid materials that maybe held in planar relation to one another when static, but when contact is made with a supporting surface, each element can be caused to tip out of plane about the line of contact, independent of its neighbor, until moment forces are balanced when the length of the element lays against the supporting surface and comes to momentary rest.

It is an object of this invention to utilize elements having congruent long edges and lay in a plane when at rest and can be a variety of shapes, or combinations of shapes including rods, tubes, fingers or plates of various shapes and orientations and numbers more than one, and can be fabricated from many rigid materials including composites, metal, glass, ceramic, wood or plastic of sufficient rigidity. The elements can be held in planar relation to each other by a variety of methods including encasement, pinning along a linear area, nesting in flexible materials, injection molding an assemblage, attached to an axle as shown in the present embodiment, or even partially cut from a whole sheet.

It is an object of this invention to utilize elements of one or more materials selected from the group comprising carbon fiber, reinforced plastic, Kevlar® (manufactured plastic), steel, aluminum, ceramic, glass, reinforced plastic, plastic, steel, stainless steel, metal alloy and wood.

The invention is composed of two main component parts including a saddle tree and one or more interfaces having one or more elements having a passively morphing interface that has the ability to reshape and twist to match the supporting surface. In the primary application a chassis ("Saddle Tree") and a pair of opposed segmented bars having a passively morphing interface replace a conventional equine saddle tree.

The chassis is rigid and may provide a seat for the rider and a structure to attach optional cantle and optional pommel, and in the primary application has a pair of symmetrically opposed line of contact edge features that are generally perpendicular to transverse sections of the horse. The line of contact of the chassis acts as a fulcrum and rests upon a linear area of the segmented bars having a segmented passively morphing surface which is supported by the horse's back.

In the primary application, the chassis's line of contact touches along the midline of a pair of opposing segmented interface bars. The chassis and interface can be held together by various means including gravity, encasement, Velcro® (Hook-and-loop fasteners), hinges of various types, straps or cables, pins, axle, magnets, and rubber strip hinge in the present embodiment.

In the primary application, the concentrated downward force from the rider's weight is distributed to the horse's back via a direct load path through the rigid chassis along the line of contact to a line on each of a pair of opposing segmented interface bars, and thence apportioned to each of a multiplicity of elements to the supporting horseback surface. The elements can independently tip out of their static planar relations when contact is made with the horse's back. Each element will tip out of plane until moment forces are equalized about it's line of contact with the chassis, which occurs when the element's entire length makes contact with the supporting horse's back and moment forces are balanced momentarily about a fulcrum. The force balancing occurs without directed input. Each individual element, independent of it's neighbor, is caused to be tipped out of plane by local contact with the horse's back causing the segmented interface bar's surface to be reshaped passively to match the varying supporting surface profiles of a horse's dynamic back and of horses of varying sizes and shapes.

The line of contact between the segmented interface bar and chassis is determined by edge profile and method of attachment. In the primary example, the chassis has a symmetrically opposed pair of line of contact edge profiles which are generally perpendicular to transverse sections of a horse and maybe conveniently determined by a section line thru a tilted sagittal plane cutting the horse's back surface profile. The profile of the line of contact can be altered as desired by direct input by machining, sanding, casting, edge tilting, rotation, shimming, clips, inserts and other means.

Thus, in the primary application, the rider's weight is evenly distributed via a direct load path to each individual element making contact with the horse's back and sharing the load.

An equine saddle with a Segmented Interface Bar that passively morphs in surface profile to be reshaped upon contact with a supporting surface of a horse's dynamic back and of horses of varying sizes and shapes, so that a direct load path is created from the riders concentrated downward weight on a chassis through a pair of symmetrically opposed line of contact edges, aligned with tilted sagittal plane sections through the horse's back surface, and making contact with a line on an opposed pair of segmented interface bars made of rigid elements that are caused to tip out of plane until moment forces are balanced, which occurs when the element's entire length makes contact with the supporting horse's back causing the segmented bar interface's surface profile to be reshaped, without directed input, to momentarily match the varying supporting surface profiles of a horse's dynamic back.

The saddle may include fasteners for attaching the saddle to the back of an animal. The fasteners may comprise one or more straps.

It is an object of this invention to create a saddle tree device that is easy to manufacture, reliable in operation, and is efficient to produce.

It is an object of this invention to create one or more rigid segmented bar devices that is easy to manufacture, reliable in operation, and is efficient to produce.

In addition to the above objects, various other objects of this invention will be apparent from careful reading of this specification including the detailed description contained herein below.

BRIEF DESCRIPTION OF DRAWINGS

These as well as other features of the present invention will become more apparent upon reference to the accompanying drawings wherein like numerals designate corresponding parts in the several figures summarized as follows.

Other features and advantages of the invention will be become apparent from the following detailed description, taken in conjunction with the accompany drawings, which illustrate, by way of example, various features of the invention.

DETAILED DESCRIPTION OF THE PREFERRED EMBODIMENTS

The following detailed description and accompanying drawings are provided for purposes of illustrating and describing presently preferred embodiments of the present invention and are not intended to limit the scope of the invention in anyway. It will be understood that various changes in the details, materials, arrangements of parts or operational conditions which have been herein described and illustrated in order to explain the nature of the invention may be made by those skilled in the art within the principles and the scope of the invention.

An equine saddle shown with an interface [4] that passively morphs in surface profile to be reshaped upon contact with a supporting surface of a horse's dynamic back and of horses of varying sizes and shapes, so that a direct load path is created from the riders concentrated downward weight on a chassis [1] through a pair of symmetrically opposed line of contact [2] edges, aligned with tilted sagittal plane sections through the horse's back surface, and making contact with an area of opposed pair of interfaces [4] having one or more elements [5] made of rigid materials that are caused to tip out of plane until moment forces are balanced, which occurs when the element's [5] entire length makes contact with the supporting horse's back causing the interface's [4] surface profile to be reshaped, without directed input, to momentarily match the varying supporting surface profiles of a horse's dynamic back.

Referring to FIGS. 1-12 showing the invention a SADDLE WITH INTERFACE HAVING PASSIVELY MORPHING ELEMENTS AND METHOD OF USE.

The invention overcomes the problem of uneven load distribution on a variable surface by providing a direct load path from a concentrated downward force to a rigid segmented interface that passively morphs in surface profile to become reshaped to match the supporting surface shape.

Figure 1:
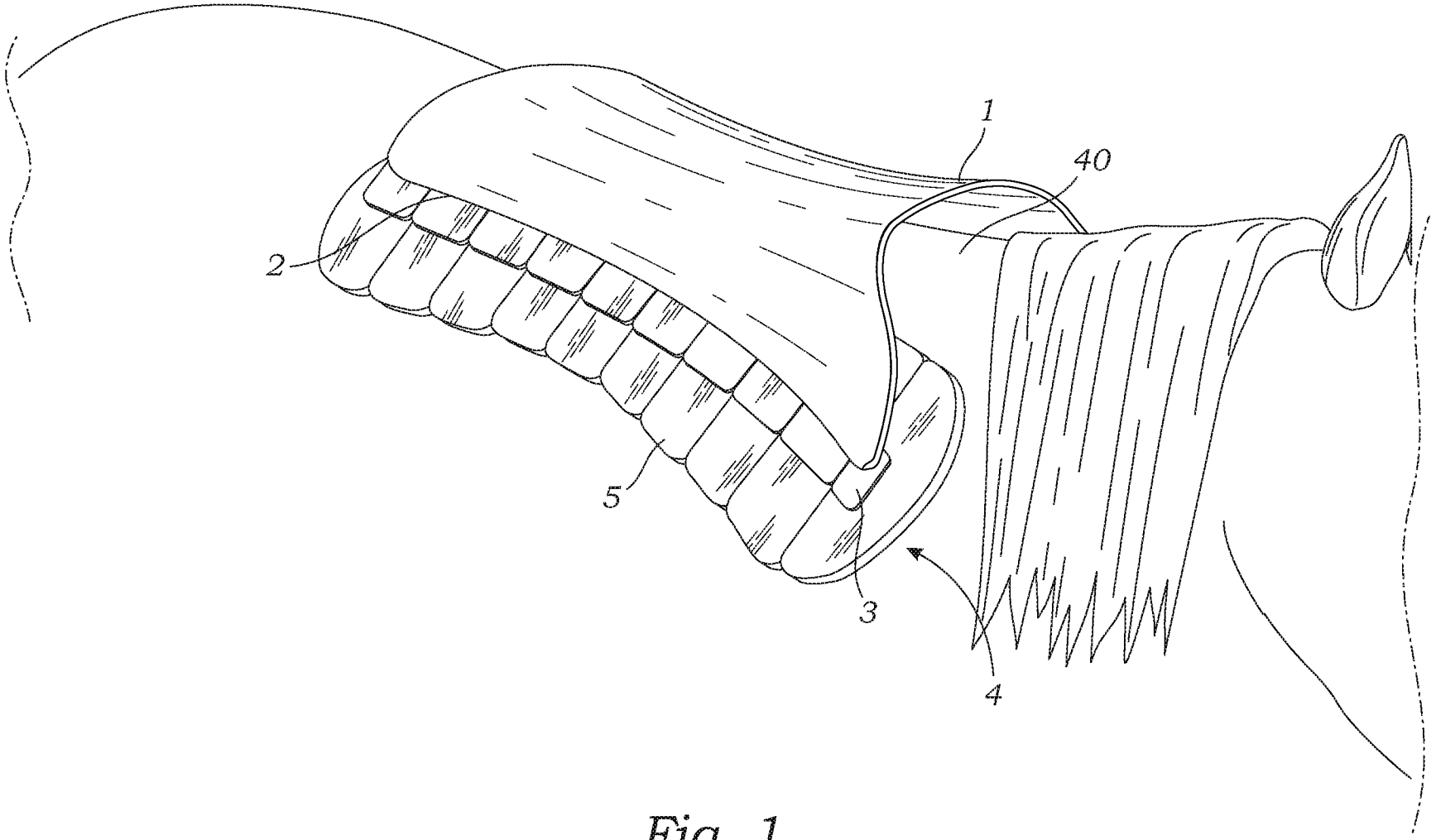
FIG. 1 is a prospective view of the chassis 1 with a pair of interfaces 4 each having one or more elements 5 having a passively morphing surface profile, wherein said chassis 1 is hinged 3 to both of said interfaces 4 on each side of the support surface 40 (horse) and a line of contact 2 placed down a line of each interface.
Figure 2:
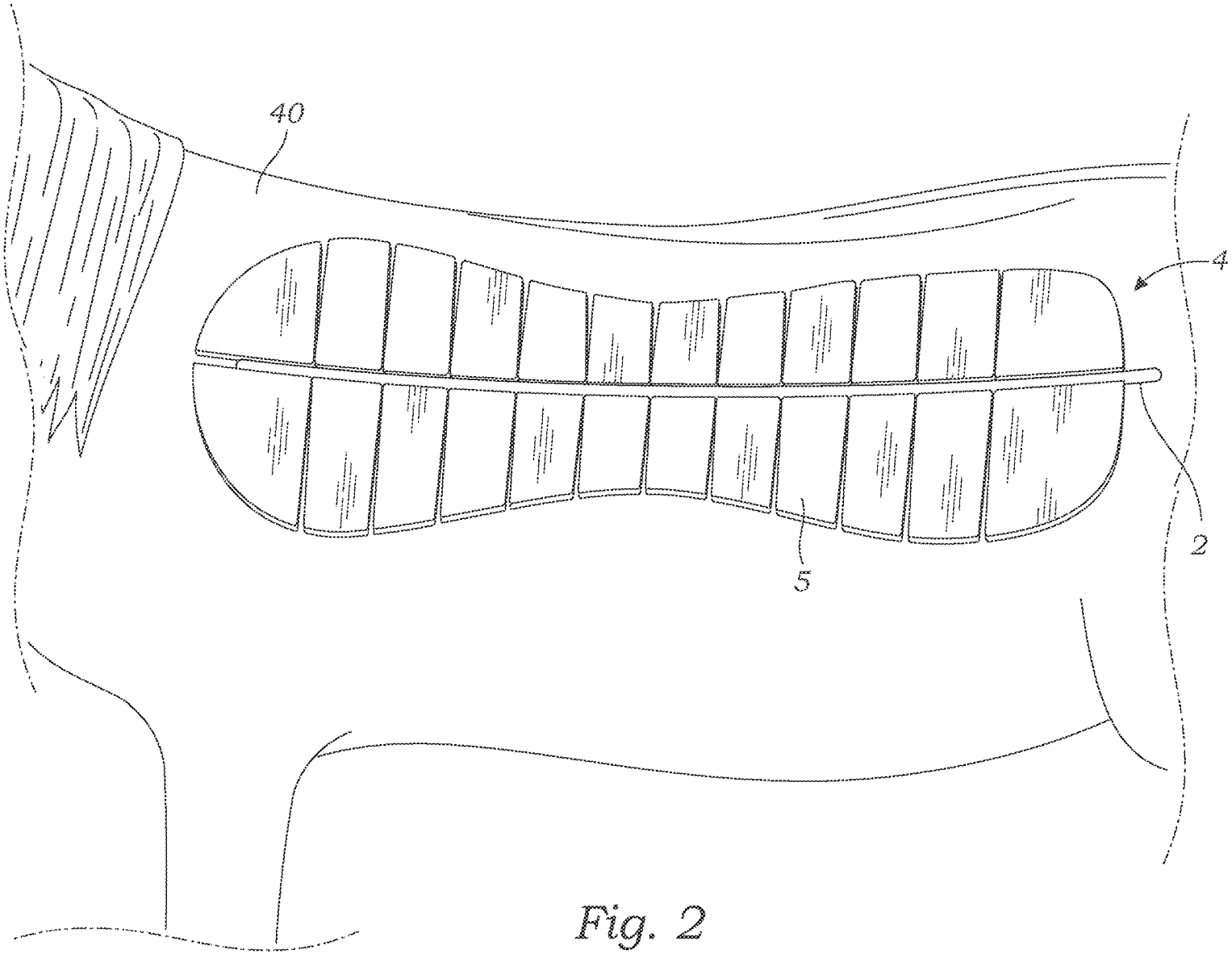
FIG. 2 is a prospective view of an alternative embodiment of the interface 4 having one or more elements having a passively morphing surface and a line of contact 2 placed down a line of each interface 4.
Figure 3:
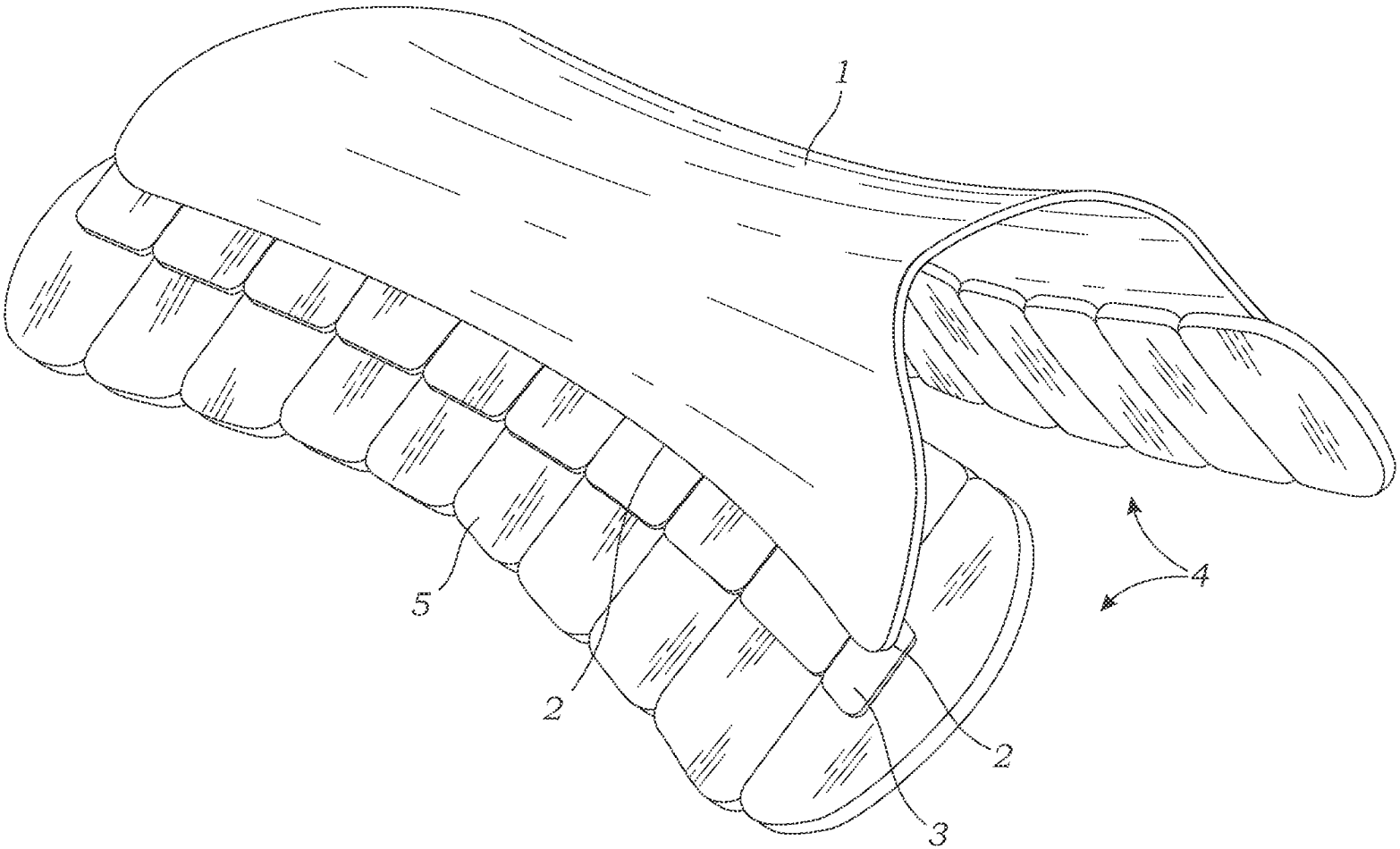
FIG. 3 is a prospective view of the chassis 1 with a pair of interfaces 4 each having one or more elements 5 having a passively morphing surface, wherein said chassis 1 is connected 3 to the midline of the interface 4 on each side of the horse.
Figure 4:
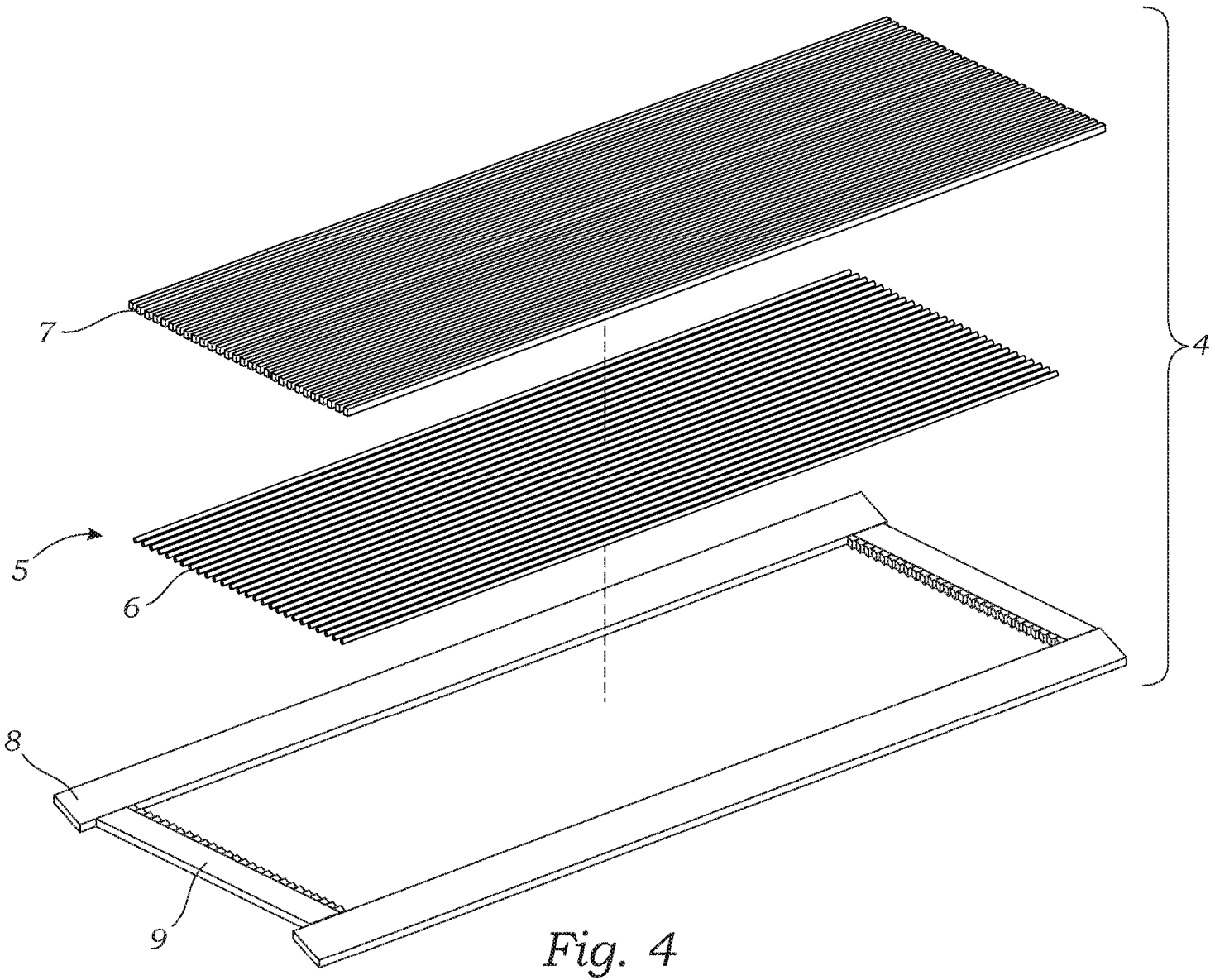
FIG. 4 is the preferred embodiment of the interface 4 showing an exploded view of elements 5 made of rigid material 6 such as carbon fiber tubes, wherein foam spacers 7 are positioned between each element 5, end caps 9, and side walls 10.
Figure 5:
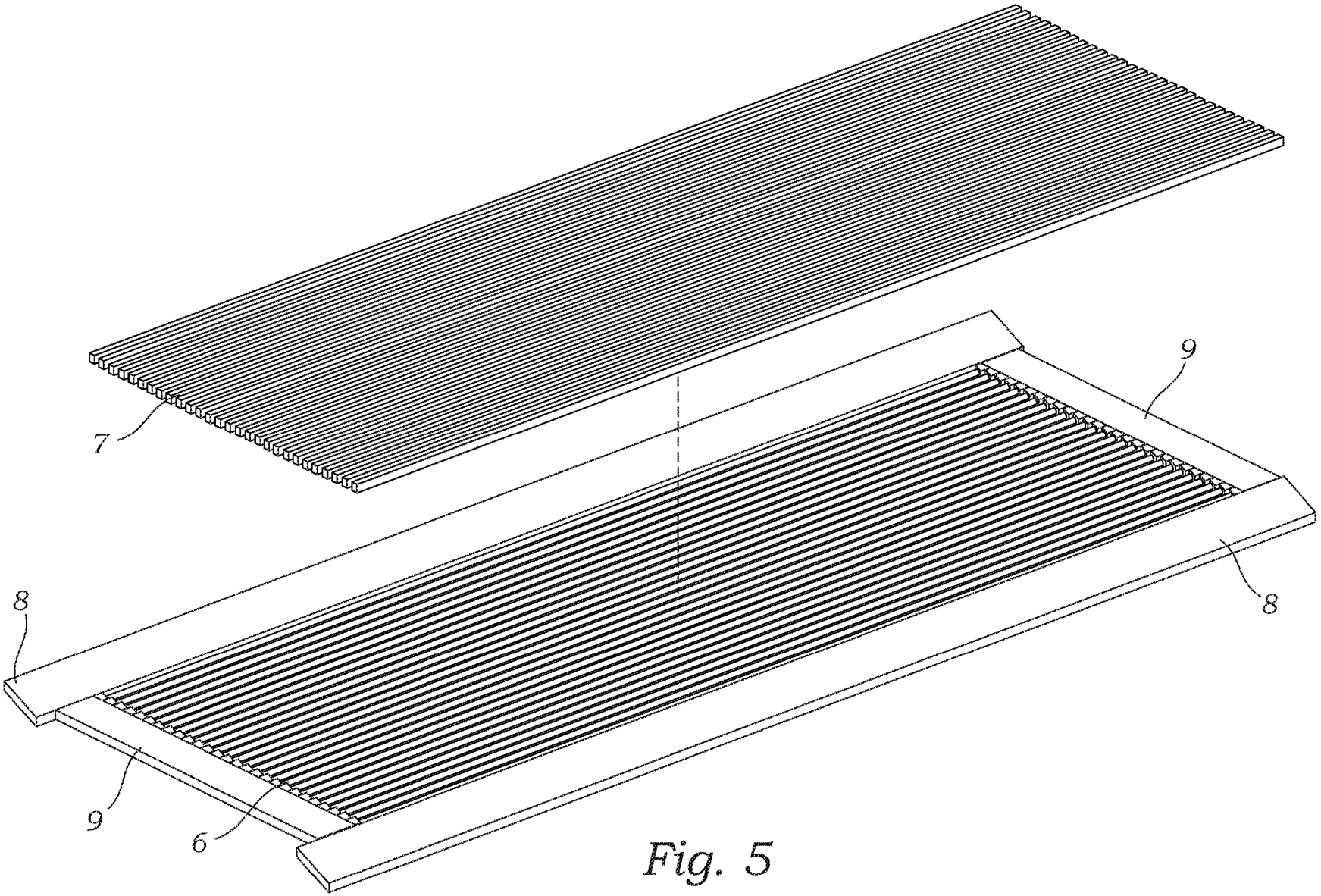
FIG. 5 is the preferred embodiment of the interface 4 showing a partial exploded view of elements 5 made of rigid material 6, wherein the rigid materials 6 are angled to allow for passive morphing that reshapes and twists to match the support surface 40 and wherein the rigid materials 6 are placed between the end caps 9 and side walls 8 with the foam inserts 7 shown above that are positioned between each of the elements 5.
Figure 6:
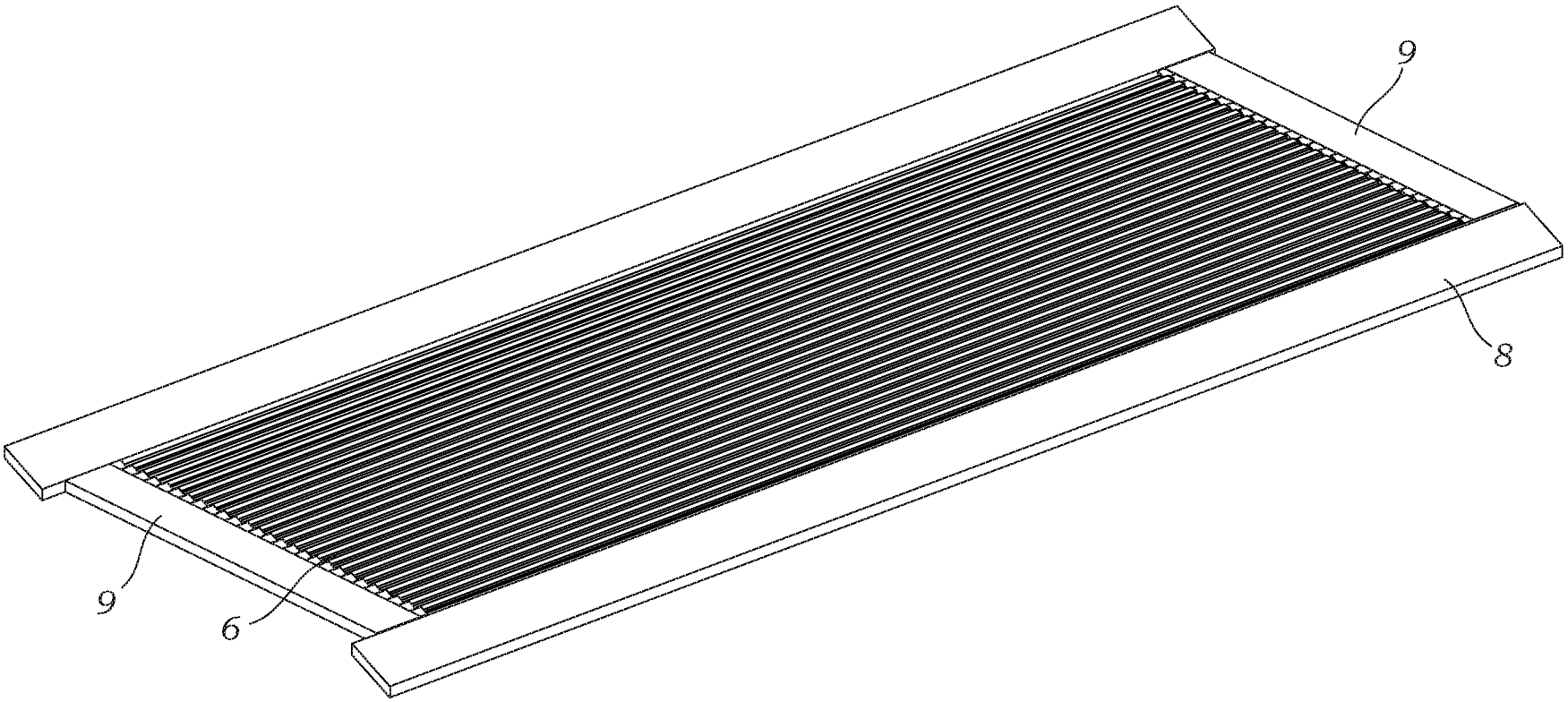
FIG. 6 is a prospective view of the preferred embodiment showing the interface comprised of one or more elements, foam spacers, end caps, and side walls.
Figure 7:
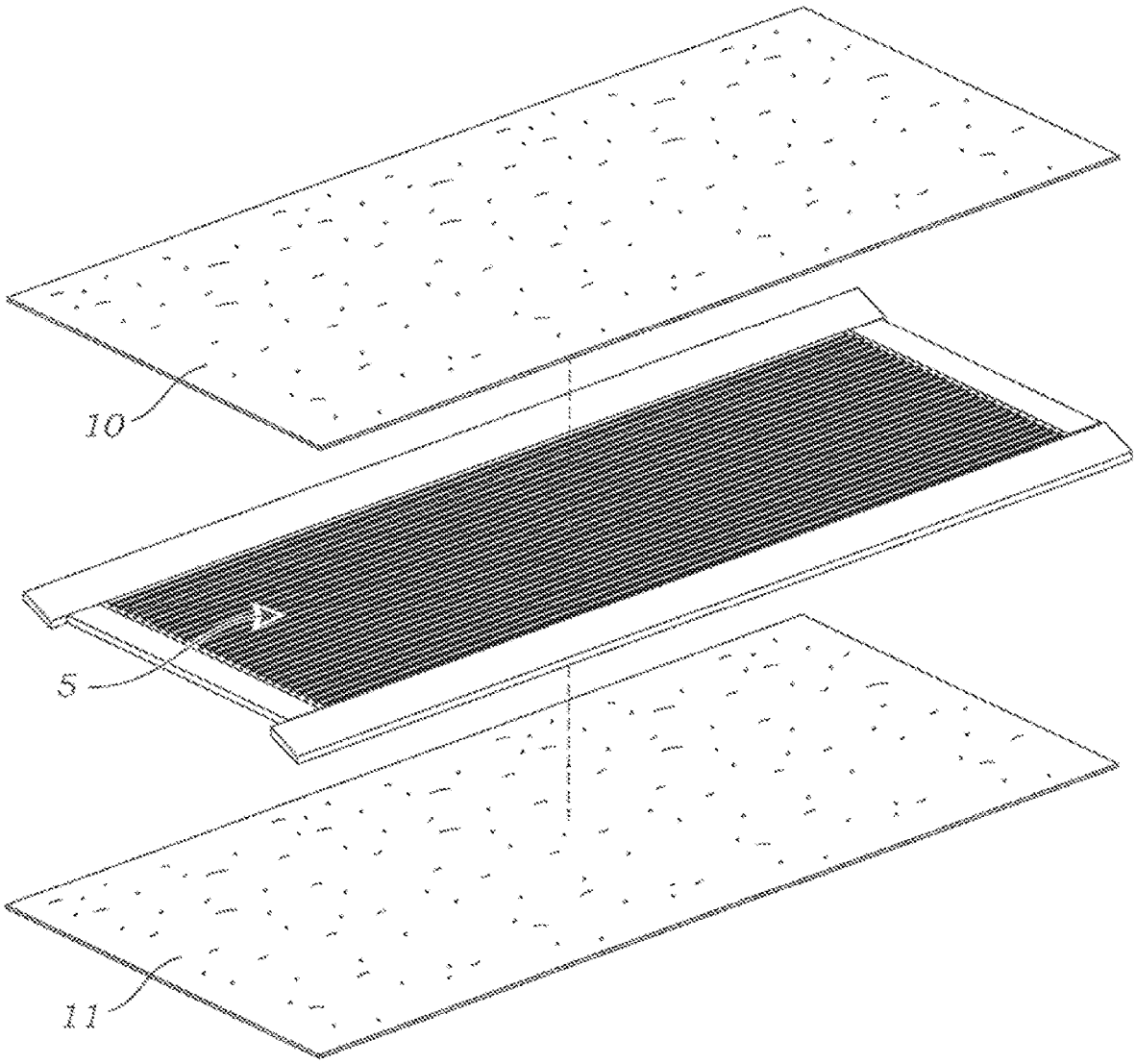
FIG. 7 is an exploded view showing top foam sheet 10 and bottom foam sheet 11 that is sandwiched between the panel showing the elongated carbon fiber support tubes, foam spacers, end caps, and side walls.
Figure 8:
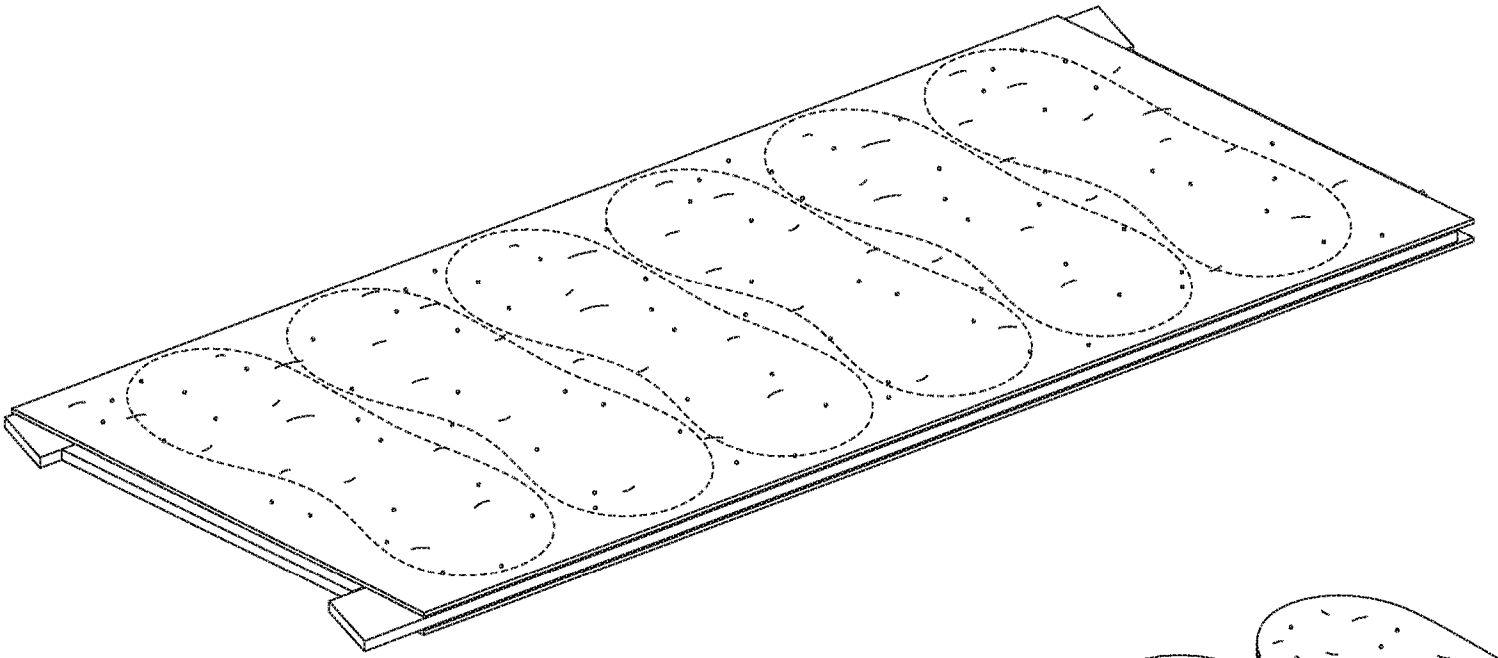
FIG. 8 is a perspective view showing the top and bottom foam sheet that are sandwiched between the panel showing the elongated carbon fiber support tubes, foam spacers, end caps, and side walls, wherein the interface is stamped out.
Figure 9:
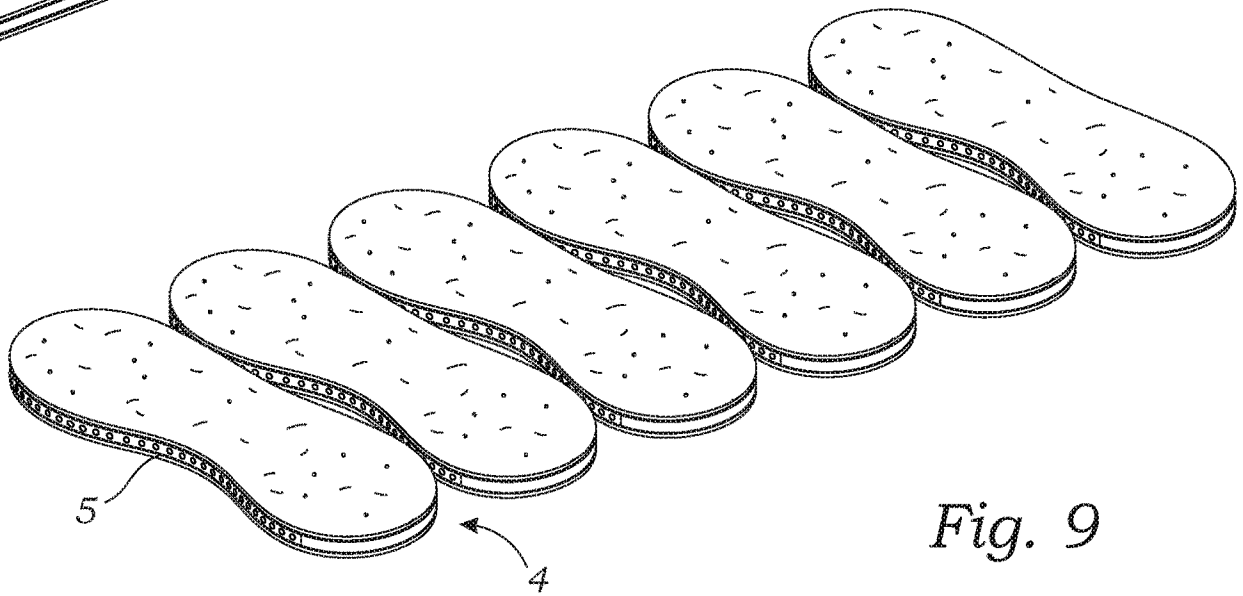
FIG. 9 is a perspective view of the interface stamped out of the mold.
Figure 10:
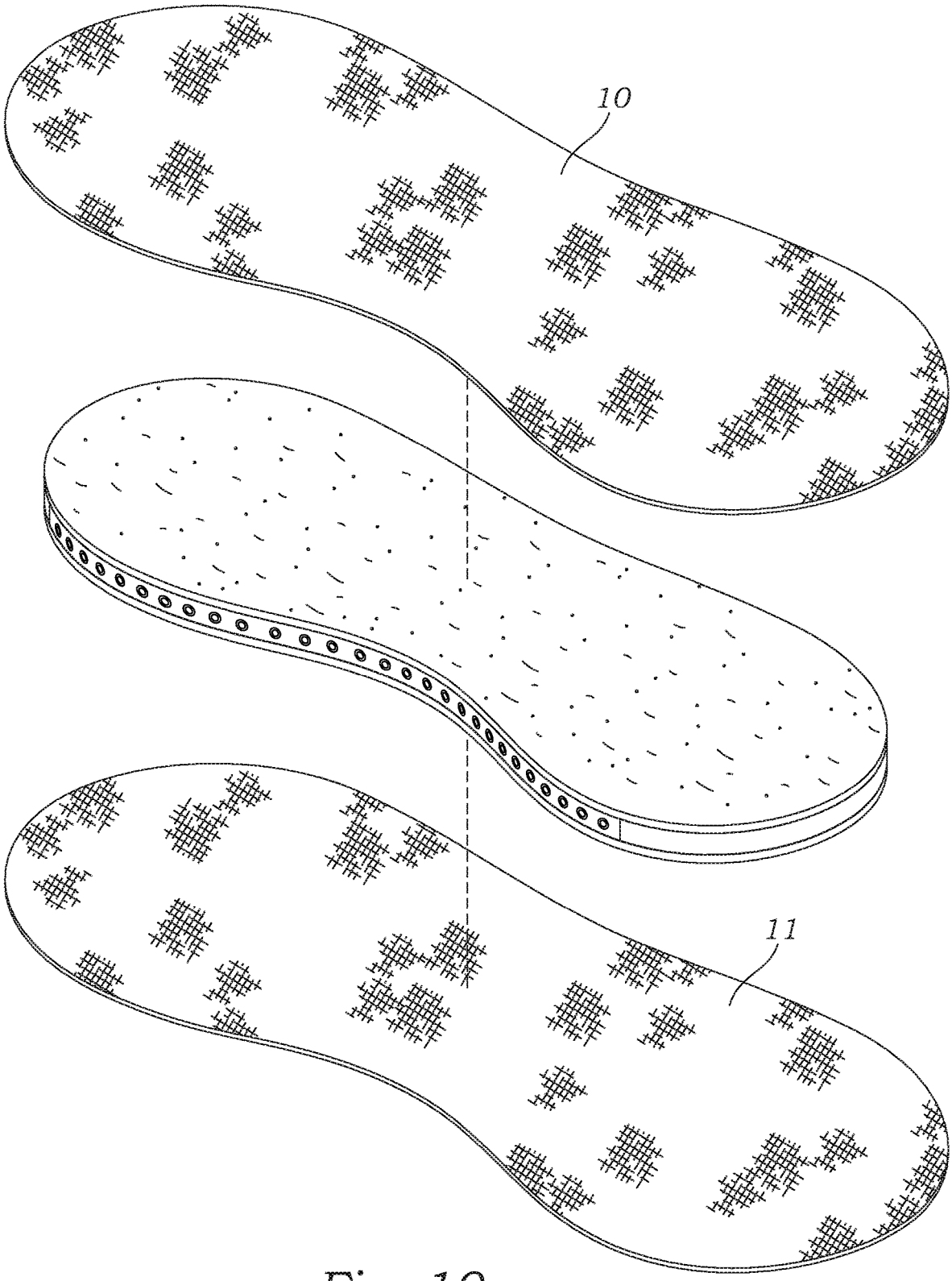
FIG. 10 is a perspective view showing an additional optional top foam sheet 10 and bottom foam sheet 11 that are sandwiched between the interfaces after the interface has been stamped out.
Figure 11:
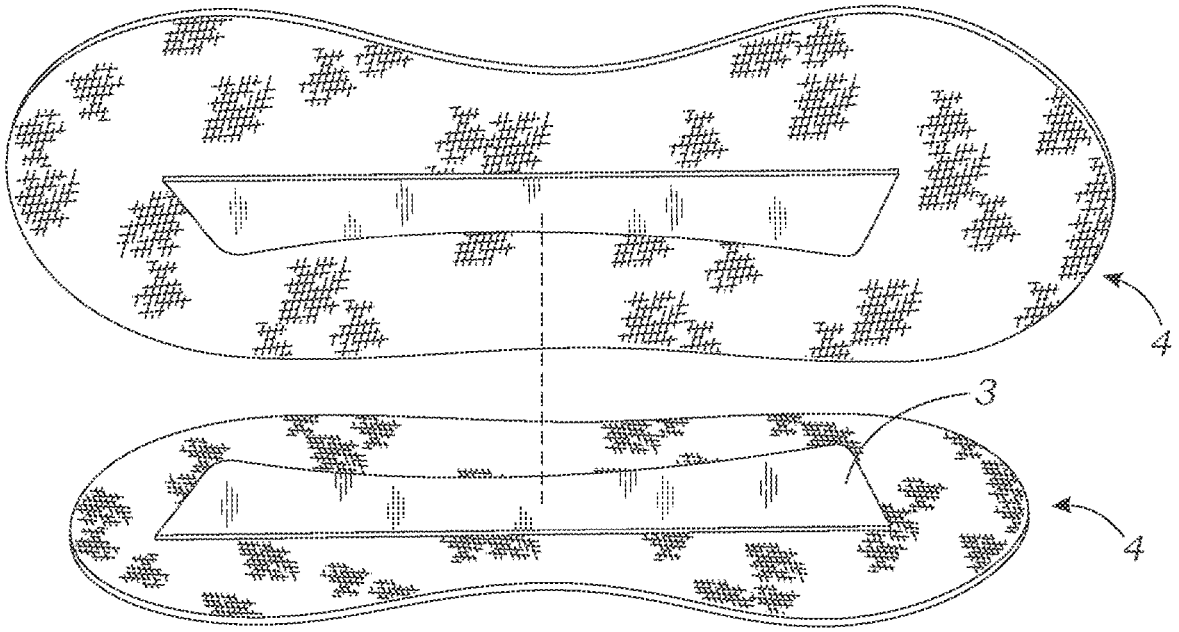
FIG. 11 is a perspective view of the two interfaces having one or more elements showing the midline of the bars.
Figure 12:
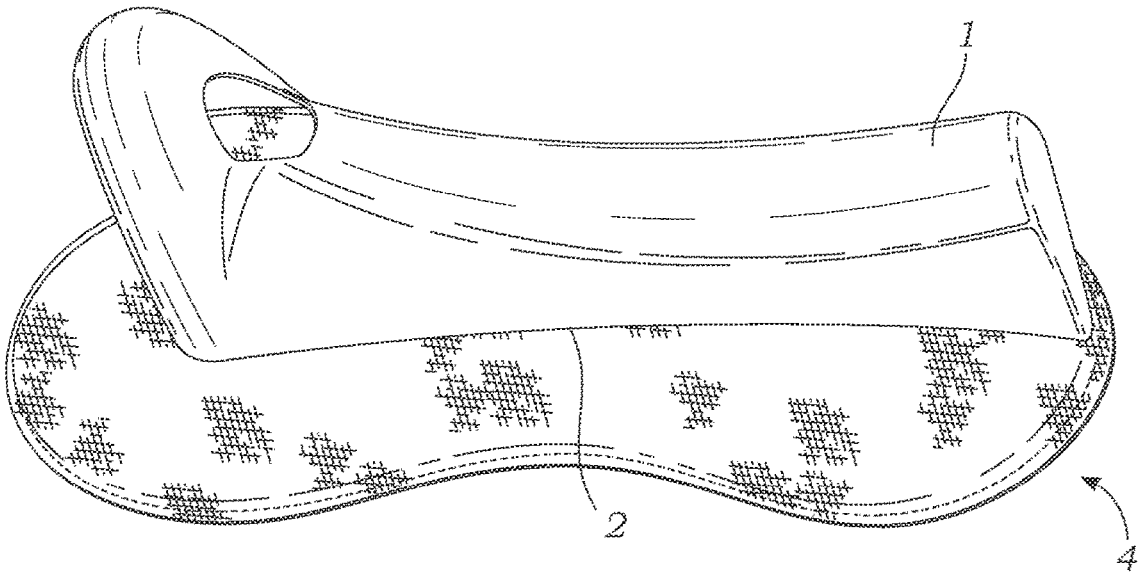
FIG. 12 is a prospective view of the saddle seat with two interfaces having one or more segmented bars positioned underneath said seat.

The invention is composed of two main component parts including a Chassis [1] and interface [4]. In the primary application the chassis [1] and a pair of opposed interfaces [4] having one or more elements [5] replace a conventional equine saddle tree as shown in FIG. 1.

The chassis [1] is rigid and may provide a seat for the rider and a structure to attach optional cantle and optional pommel, and in the primary application has a pair of symmetrically opposed line of contact [2] edge features that are generally perpendicular to transverse sections of the horse. The line of contact [2] of the chassis [1] acts as a fulcrum and rests upon the midline area of the elements [5] which are supported by the horse's back.

The elements [5] are assembled from a multiplicity of rigid materials that are held in planar relation to one another when static, but when contact is made with a supporting surface, each elements [5] can be caused to tip out of plane about the line of contact [2], independent of its neighbor, until moment forces are balanced when the length of the elements [5] lays against the supporting surface and comes to momentary rest. The elements [5] have congruent long edges and lay in a plane when at rest and can be a variety of shapes, or combinations of shapes including rods, tubes, fingers or plates of various shapes and orientations and numbers, and can be fabricated from many rigid materials including composites, metal, wood or plastic of sufficient rigidity. The elements [3] can be held in planar relation to each other by a variety of methods including encasement, pinning along midline area, nesting in flexible materials, injection molding an assemblage, attached to an axle as shown in the present embodiment in FIG. 2, or even partially cut from a whole sheet.

In the primary application, the chassis's [1] line of contact [2] touches along the midline area of a pair of opposing interfaces [4] having one or more elements [5]. The chassis [1] and interface [4] can be held together by various connecting means [3] including gravity, Velcro® (Hook-and-loop fasteners), hinges of various types, straps or cables, pins, axle, magnets, and rubber strip hinge [3] in the present embodiment shown in FIG. 1.

In the primary application, the concentrated downward force from the rider's weight is distributed to the horse's back via a direct load path through the rigid chassis [1] along the line of contact [2] to the midline of each of a pair of opposing interfaces [4] having one or more elements [5], and thence apportioned to each of a multiplicity of rigid materials to the supporting horse back surface [10]. The elements [5] can independently tip out of their static planar relations when contact is made with the horse's back. Each element [5] will tip out of plane until moment forces are equalized about it's line of contact [2] with the Chassis [1], which occurs when the element's [5] entire length makes contact with the supporting horse's back and moment forces are balanced momentarily about a fulcrum. The force balancing occurs without directed input. Each individual element [5], independent of it's neighbor, is caused to be tipped out of plane by local contact with the horse's back causing the interface [4] surface to be reshaped passively to match the varying supporting surface [10] profiles of a horse's dynamic back and of horses of varying sizes and shapes.

The Line of Contact [2] between the interfaces [4] and chassis [1] is determined by edge profile and method of attachment. In the primary example, the chassis [1] has a symmetrically opposed pair of line of contact [2] edge profiles which are generally perpendicular to transverse sections of a horse and maybe conveniently determined by a section line thru a tilted sagittal plane cutting the horse's back surface profile. The profile of the line of contact [2] can be altered as desired by direct input by machining, sanding, casting, edge tilting, rotation, shimming, clips, inserts and other means.

Thus, in the primary application, the rider's weight is evenly distributed via a direct load path to each individual element [5] making contact with the horse's back and sharing the load.

A saddle comprising: a seat and one or more interfaces, wherein said interfaces are positioned underneath said seat to distribute the weight of the rider sitting in said seat more evenly along the entire length of said seat; said interfaces are constructed with one or more elements with a line of contact positioned down along said elements; said interfaces provides a passively morphing surface that has the ability to reshape and twist to match a supporting surface; said elements are assembled from one or more rigid support materials that are held in planar relation to one another when static, but when contact from said seat is made with said elements, each element can be caused to tip out of plane about said line of contact, independent of its neighbor, until moment forces are balanced when the length of the element lays against the supporting surface and comes to momentary rest; wherein said interface can tip and twist; and wherein said elements in said interface provide said rigid support materials for protecting said supporting surface.

Wherein said seat may be selected from the group comprising chassis, equine saddle, saddle tree, treeless saddle, Australian saddle, English saddle, and western saddle.

Wherein the elements may be of one or more materials selected from the group comprising carbon fiber, reinforced plastic, Kevlar® (manufactured plastic), steel, aluminum, ceramic, glass, plastic, steel, metal alloy and wood.

Wherein the elements may be of one or more materials of a various shapes selected from the group comprising rods, tubes, fingers, plates, and bars.

Wherein the elements may be arranged in one or more orientations selected from the group comprising vertical and diagonal, but not horizontal.

Wherein the elements may be arranged in overlapping orientations selected from the group comprising vertical, diagonal, and horizontal.

Wherein the elements may be held in planar relation to each other by a variety of methods selected from the group comprising encasement, pinning along midline area, nesting in flexible materials, injection molding an assemblage, ball & socket, attached to an axle, snap & fit, and even partially cut from a whole sheet.

Wherein said bars are constructed from one or more elements having elongated support members that are positioned between one or more foam spacers, end caps, and side walls.

Further comprising a top foam sheet and a bottom foam sheet that are sandwiched between one or more elements having said elongated support members that are positioned between one or more foam spacers, end caps, and side walls.

Wherein said seat is connected to said line of contact of the segmented bars on each side of the horse.

A saddle comprising: a seat and one or more interfaces, wherein said interfaces are positioned underneath said seat to distribute the weight of the rider sitting in said seat more evenly along the entire length of said seat to provide a supporting surface; said interfaces are constructed with one or more elements with a line of contact positioned down a linear area of said elements; said interfaces provides said passively morphing supporting surface that has the ability to reshape and twist to match said supporting surface; said elements are assembled from one or more rigid materials that are held in planar relation to one another when static, but when contact from said seat is made with said elements, each element can be caused to tip out of plane about a line of contact, independent of its neighbor, until moment forces are balanced when the length of the element lays against said supporting surface and comes to momentary rest; said elements are constructed from one or more elongated rigid materials; said elements are constructed from one or more elongated rigid materials that are positioned between one or more foam spacers, end caps, and side walls, and wherein a top foam sheet and a bottom foam sheet are sandwiched between said elongated support members, said foam spacers, said end caps, and said side walls; wherein said interface can rotate and twist; and wherein said elements in said interface provide said rigid material for protecting said supporting surface.

A method for using a saddle comprising the steps: providing a seat and one or more interfaces; placing one or more interfaces underneath said seat to distribute the weight of the rider sitting on said seat more evenly along the entire length of said seat; wherein said interfaces are constructed with one or more elements with a line of contact positioned down along said elements for when said seat comes into contact with said elements on each side; wherein said interfaces provides a passively morphing surface that has the ability to reshape and twist to match and protect a supporting surface; wherein said elements are assembled from one or more rigid materials that are held in planar relation to one another when static, but when contact from said seat is made with said elements, each element can be caused to tip out of plane about the midline of Contact, independent of its neighbor, until moment forces are balanced when the length of the element lays against said supporting surface and comes to momentary rest; and wherein said elements in said interface provide said rigid material for protecting said supporting surface.

Wherein the elements may be held in planar relation to each other by a variety of methods selected from the group comprising encasement, pinning along midline area, nesting in flexible materials, injection molding an assemblage, attached to an axle, balls & sockets, snap & fit, and even partially cut from a whole sheet.

Wherein said bars are constructed from one or more elements having elongated support members that are positioned between one or more foam spacers, end caps, and side walls.

Further comprising a top foam sheet and a bottom foam sheet that are sandwiched between one or more elements having said elongated support members that are positioned between one or more foam spacers, end caps, and side walls.

An alternative Embodiment of the Invention, wherein:

1. A SADDLE SUPPORT SURFACE COMPRISING: one or more interfaces, wherein said interfaces are positioned underneath said seat to distribute the weight of the rider sitting in said seat more evenly along the entire length of said seat; said interfaces are constructed with one or more segmented bars with a line of contact positioned down the midline of the bars; said interfaces provides a passively morphing surface that has the ability to reshape and twist to match the supporting surface; said segmented bars are assembled from a two or more rigid elements that are held in planar relation to one another when static, but when contact from said seat is made with said elements, each element can be caused to tip out of plane about the midline of contact, independent of its neighbor, until moment forces are balanced when the length of the element lays against the supporting surface and comes to momentary rest; wherein said interface can rotate and twist; and wherein said elements in said interface provide a rigid support bar for said supporting surface.

2. A saddle support surface, wherein the elements may be of one or more materials selected from the group comprising carbon fiber, reinforced plastic, Kevlar® (manufactured plastic), steel, aluminum, ceramic, glass, plastic, steel, metal alloy and wood.

3. A saddle support surface, wherein the elements may be of one or more materials of a various shapes selected from the group comprising rods, tubes, fingers, plates, and bars.

4. A saddle support surface, wherein the elements may be arranged in one or more orientations selected from the group comprising vertical and diagonal, but not horizontal.

5. A saddle support surface, wherein the elements may be arranged in overlapping orientations selected from the group comprising vertical, diagonal, and horizontal.

6. A saddle support surface, wherein the elements may be held in planar relation to each other by a variety of methods selected from the group comprising encasement, pinning along midline area, nesting in flexible materials, injection molding an assemblage, ball & socket, attached to an axle, snap & fit, and even partially cut from a whole sheet.

7. A saddle support surface, wherein said bars are constructed from one or more elements having elongated support members that are positioned between one or more foam spacers, end caps, and side walls.

8. A saddle support surface, further comprising a top foam sheet and a bottom foam sheet that are sandwiched between one or more elements having said elongated support members that are positioned between one or more foam spacers, end caps, and side walls.

While the description above refers to a particular embodiment of the present invention, it will be understood that many modifications may be made without departing from the spirit thereof. The presently disclosed embodiments are therefore to be considered in all respects as illustrative and not restrictive.

I claim:

1. A saddle comprising:

a seat and one or more interfaces, wherein said interfaces are positioned underneath said seat to distribute the weight of the rider sitting in said seat more evenly along the entire length of said seat to provide a supporting surface;

said interfaces are constructed with one or more elements with a line of contact positioned down a linear area of said elements;

said interfaces provides said passively morphing supporting surface that has the ability to reshape and twist to match said supporting surface;

said elements are assembled from one or more rigid materials that are held in planar relation to one another when static, but when contact from said seat is made with said elements, each element can be caused to tip out of plane about a line of contact, independent of its neighbor, until moment forces are balanced when the length of the element lays against said supporting surface and comes to momentary rest;

said elements are constructed from one or more elongated rigid materials;

said elements are constructed from one or more elongated rigid materials that are positioned between one or more foam spacers, end caps, and side walls, and wherein a top foam sheet and a bottom foam sheet are sandwiched between said elongated support members, said foam spacers, said end caps, and said side walls;

wherein said interface can reshape and twist; and wherein said elements in said interface provide said rigid material for protecting said supporting surface.

2. The saddle according to claim 1, wherein said seat may be selected from the group comprising chassis, equine saddle, saddle tree, treeless saddle, Australian Saddle, English saddle, and western saddle.

3. The saddle according to claim 1, wherein the Elements may be of one or more rigid materials selected from the group comprising composite, glass, ceramic, metals, reinforced plastic, wood, and metal alloy.

4. The saddle according to claim 1, wherein the Elements may be of one or more materials of a various shapes, orientations, and numbers selected from the group comprising rods, tubes, fingers, and plates.

5. The saddle according to claim 1, wherein the Elements may be held in planar relation to each other by a variety of methods selected from the group comprising encasement, pinning along midline area, nesting in flexible materials, injection molding an assemblage, attached to an axle, and even partially cut from a whole sheet.

6. The saddle according to claim 1, wherein said seat is connected to said line by a hinge on said interface on each side of the horse.

* * * * *